US007147181B2

(12) United States Patent
Selin et al.

(10) Patent No.: US 7,147,181 B2
(45) Date of Patent: Dec. 12, 2006

(54) CANARD FIN UNIT

(75) Inventors: Lennart Selin, Kristinehamn (SE); Reijo Vesa, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 436 days.

(21) Appl. No.: 10/362,825

(22) PCT Filed: Aug. 24, 2001

(86) PCT No.: PCT/SE01/01801

§ 371 (c)(1),
(2), (4) Date: Sep. 5, 2003

(87) PCT Pub. No.: WO02/18867

PCT Pub. Date: Mar. 7, 2002

(65) Prior Publication Data

US 2006/0071120 A1 Apr. 6, 2006

(30) Foreign Application Priority Data

Aug. 31, 2000 (SE) ..... 0003061

(51) Int. Cl.
*F42R 10/00* (2006.01)

(52) U.S. Cl. ..... 244/3.27

(58) Field of Classification Search ..... 244/3.27, 244/3.28, 3.29, 3.24, 3.25
See application file for complete search history.

(56) References Cited

U.S. PATENT DOCUMENTS 3,114,315 A * 12/1963 Trump ..... 102/388
4,438,893 A * 3/1984 Sands et al. ..... 244/3.21
5,114,095 A * 5/1992 Schroppel et al. ..... 244/3.28
6,186,443 B1 2/2001 Shaffer
6,726,147 B1 * 4/2004 Perini et al. ..... 244/3.27

FOREIGN PATENT DOCUMENTS

GB 2246330 A 1/1992

* cited by examiner

*Primary Examiner*—Tien Dinh
(74) *Attorney, Agent, or Firm*—Connolly Bove Lodge & Hutz LLP; Larry J. Hume

(57) ABSTRACT

The invention relates to a canard fin unit intended for guiding artillery projectiles (1) fired on ballistic trajectories, which comprises a number of identical canard fins, deployable from a first passive, retracted position into a second active position once the projectile (1) associated with the fin unit has been launched from the barrel from which it is intended to be fired, the canard fins (3*a–d*) in the active position being individually controllable. The invention resides in the fact that each canard fin (3*a–d*) is individually supported and controlled in its own swivel arm (6*a–d*), extending in the longitudinal direction of the projectile, which arm is in turn pivoted about its own swivel shaft (7*a–d*) arranged transversely to the direction of flight of the projectile, the swivel arms (6*a–d*) of all canard fins (3*a–d*) being moved together from the retracted to the deployed position by one and the same operating element (10), displaceable in the longitudinal direction of the projectile. In an especially preferred embodiment of the canard fin unit according to the invention the said fins (3*a–d*) are each coupled to their respective control elements (8*a–d*), 9*a–d*), 24*a–d*) only when they reach their respective deployed positions.

9 Claims, 5 Drawing Sheets

CANARD FIN UNIT

Figure 1:
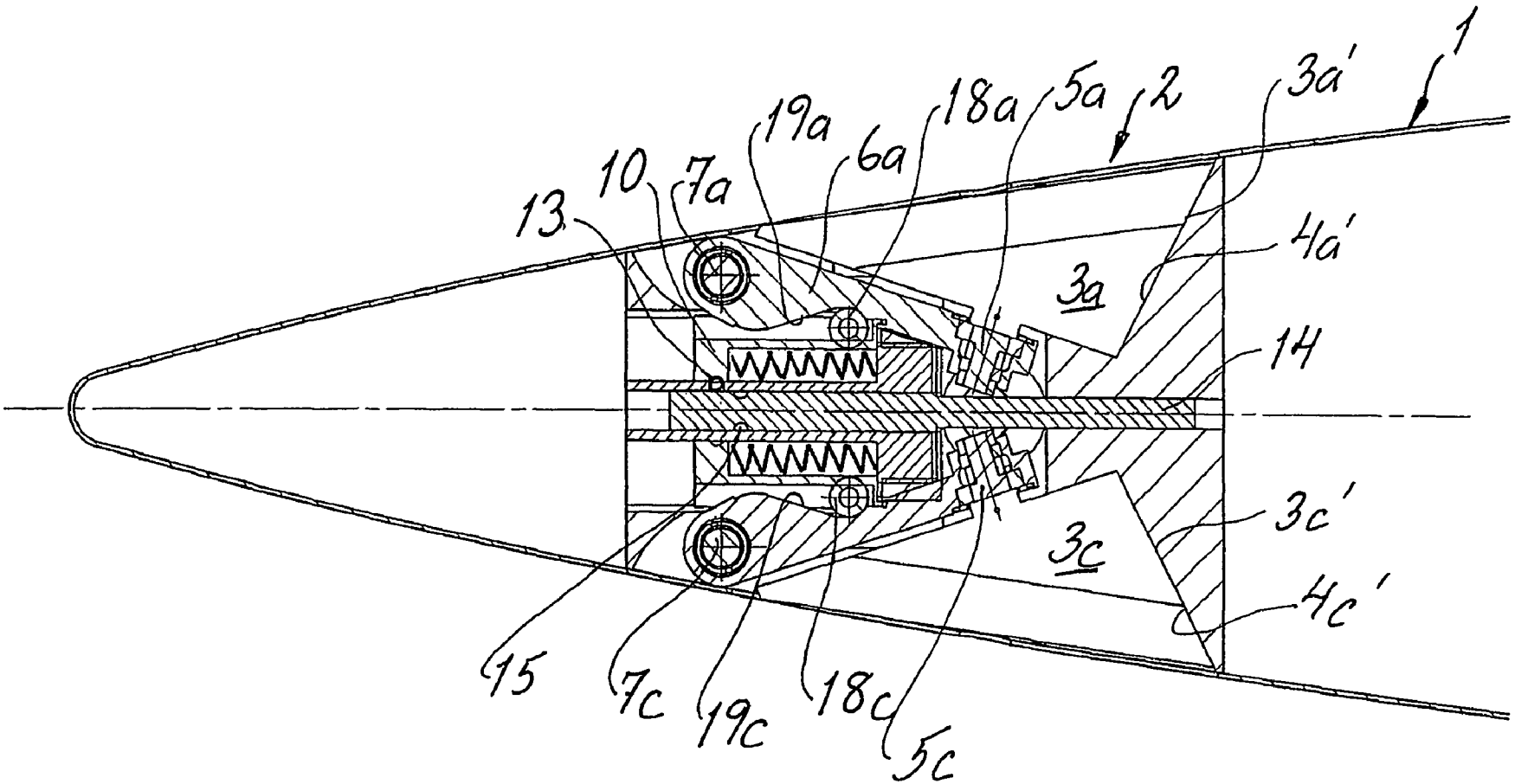

The invention relates to a canard fin unit intended for guiding artillery projectiles fired on ballistic trajectories, especially from barrelled weapons. The object of the invention is to solve the problem of providing a controllable canard fin unit, which during the launch phase of the projectile of which it forms part can be kept retracted largely within the external aerodynamic shape of the projectile and which thereafter, at the required position in the trajectory, can be deployed and activated for guiding the projectile on the trajectory.

Guided artillery projectiles of the type which are primarily fired from guns or howitzers on ballistic trajectories and the projectile trajectories of which, especially over the descending sections thereof, are corrected by remote control, are expected to become increasingly more common since they are very cost-effective.

The arrangement according to the invention therefore consists of a canard fin unit of the type that comprises a number of identical guide fins, each of which can be deployed from a first passive position, in which they lie retracted within the aerodynamic outer skin of the projectile, into a second active outer position, in which their entire fin area lies outside the said outer skin and in which the fins, on command, can be manoeuvred and angled relative to the longitudinal axis of the projectile, in order thereby to influence the trajectory of the projectile.

Apart from using controllable canard fin units, with associated control systems to increase the hit probability of artillery shells equipped therewith, canard fin units can also be used together with further, similarly deployable fin units arranged at the rear of the shell to give the shells glide characteristics that increase their range.

In order to be able to function when they need to be activated, most canard fin units of this type and their control systems must be capable of withstanding high accelerations and also rotations, which occur during the launch phase and the initial phase of the ballistic trajectory, whilst the canard fins must be capable of rapid and precise deployment at the correct instant. In the deployed position the actual control function must also be very precise, whilst the constituent canard fins must withstand the stresses to which they are exposed when activated in order to correct the trajectory of the projectile. The entire fin unit moreover only constitutes an auxiliary system and must therefore only take up minimal space in the actual projectile.

As is apparent from U.S. Pat. No. 4,438,893, the use of canard fin units for guiding artillery projectiles is not entirely new, but the fin unit described there is provided with non-retractable fins and is intended to be freely rotatable in relation to the rotationally stabilized projectile.

The basic principle of the arrangement according to the invention is that each canard fin is individually pivoted about its own swivel arm extending in the longitudinal direction of the projectile, about a guide shaft, supported in the swivel arm and arranged transversely to the direction of flight of the projectile. The various swivel arms are then in turn mounted so that they can each swivel about their own swivel shaft, which at one end is arranged transversely to its own longitudinal direction and that of the projectile, but perpendicular to the said control shaft. The swivel shaft makes it possible to deploy the swivel arm from a first inner position, in which it and the fin are sufficiently far retracted in the projectile for this to have the aerodynamic external shape required during launching, into an outer position in which the fin is situated entirely outside the external shape of the projectile, so that it can be manoeuvred by control elements adapted thereto into the desired angle relative to the longitudinal axis of the projectile. According to a development of the invention, for simultaneous manoeuvring of all swivel arms from their retracted positions to their deployed positions, use is furthermore made of an operating element displaceable in the longitudinal direction of the projectile about its central axis, which acts upon the swivel arms by way of control cams arranged on their opposing edges facing the central axis of the shell.

It is thought that the optimum variant here is to have the swivel arms supported about their swivel axes at each of the ends facing the front of the projectile and to allow the operating element to move forwards in the direction of movement of the projectile when it is activated. The operating element may also be combined with special catch elements, which in the original position lock all swivel arms to prevent accidental deployment, due to the effect, for example, of centrifugal force in a rotating projectile, and which release their grip as soon as the operating element is activated and begins to move. A spring assembly or a pyrotechnic gas accumulator was primarily considered for operation of the operating element. The variant with a spring assembly that drives the operating element, in particular, provides a construction which can be designed so that it loads the swivel arms in the deployment direction, even once these have reached their outer position, so that the swivel arms remaining in their positions are secured, even without special locks. For axial guidance of the swivel arms in the longitudinal direction of the projectile it was further proposed that the swivel arms and the body of the projectile be designed with opposed contact and control surfaces converging in the deployment direction of the swivel arms, the surfaces being brought to bear against one another in the fully deployed positions of the swivel arms and fixing the outer positions of the swivel arms on the wedge principle.

As previously stated, according to one development of the invention, the swivel arms are preferably supported at their leading ends in the direction of flight. This makes it possible to design the rear wall of the slot, in which each fin and its swivel arm are moveable, in such a way that in the retracted position the fin rests with its trailing edge against the opposing inner edge of the slot. This then enables the acceleration forces acting on the projectile during launching to be transferred directly from the fins to the body of the projectile, so that the dimensions of the fins and the fin control axes can be limited.

Another practical problem that needs to be solved in as much as it relates to artillery shells provided with deployable fins is how the shell can be provided with the best possible aerodynamic shape during the launch phase without this making actual deployment of the fins more difficult. In the case of rear-mounted fins, these are often covered by removable protective covers during the actual launch, which are then removed in connection with deployment of the fins. This type of solution cannot be used in the case of canard fins, since these are located on the front part of the shell. In the canard fin unit according to the invention the fins are deployed through open slots or slits in the outer skin of the shell and according to a development of the invention these slots or slits are covered by protective plates, which are designed with defined fracture lines along the edges of each slit. These defined fracture lines will then be pierced when each fin begins to move towards the deployed position. As soon as the canard fins are fully deployed the most aerodynamically favourable shape can then be restored in that the swivel arms, which move the canard fins from the retracted to the deployed position, fill each slit in their deployed positions.

The invention has been defined in the following claims and will now be described in somewhat greater detail with reference to figures attached, which relate to an artillery shell that can be launched on a ballistic trajectory from a barrelled weapon of the gun or howitzer type, the shell being equipped with canard guide fins that are retracted during launching but deployable on the trajectory, for guiding the shell primarily in its descending trajectory.

Figure 2:
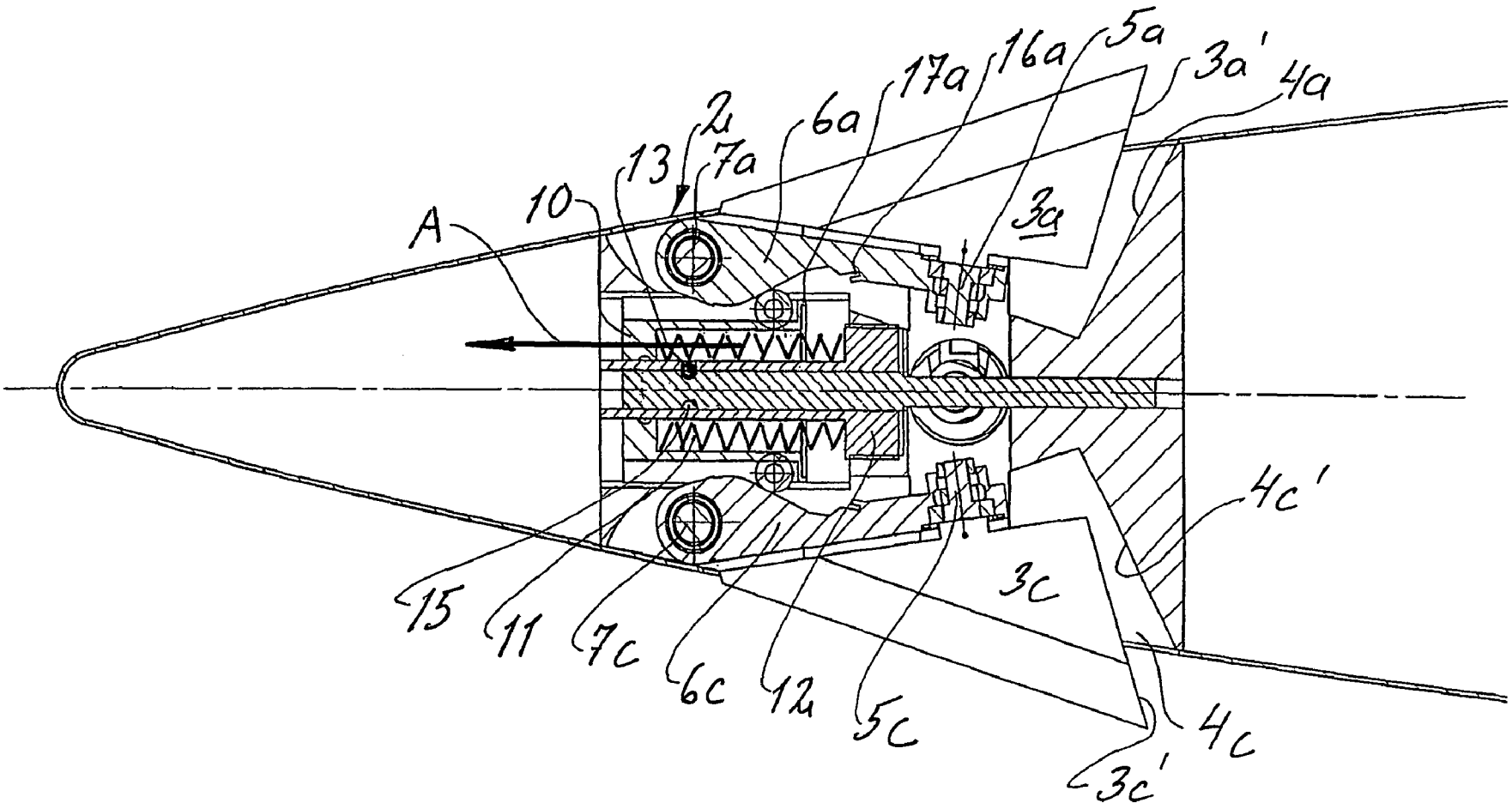
Figure 3:
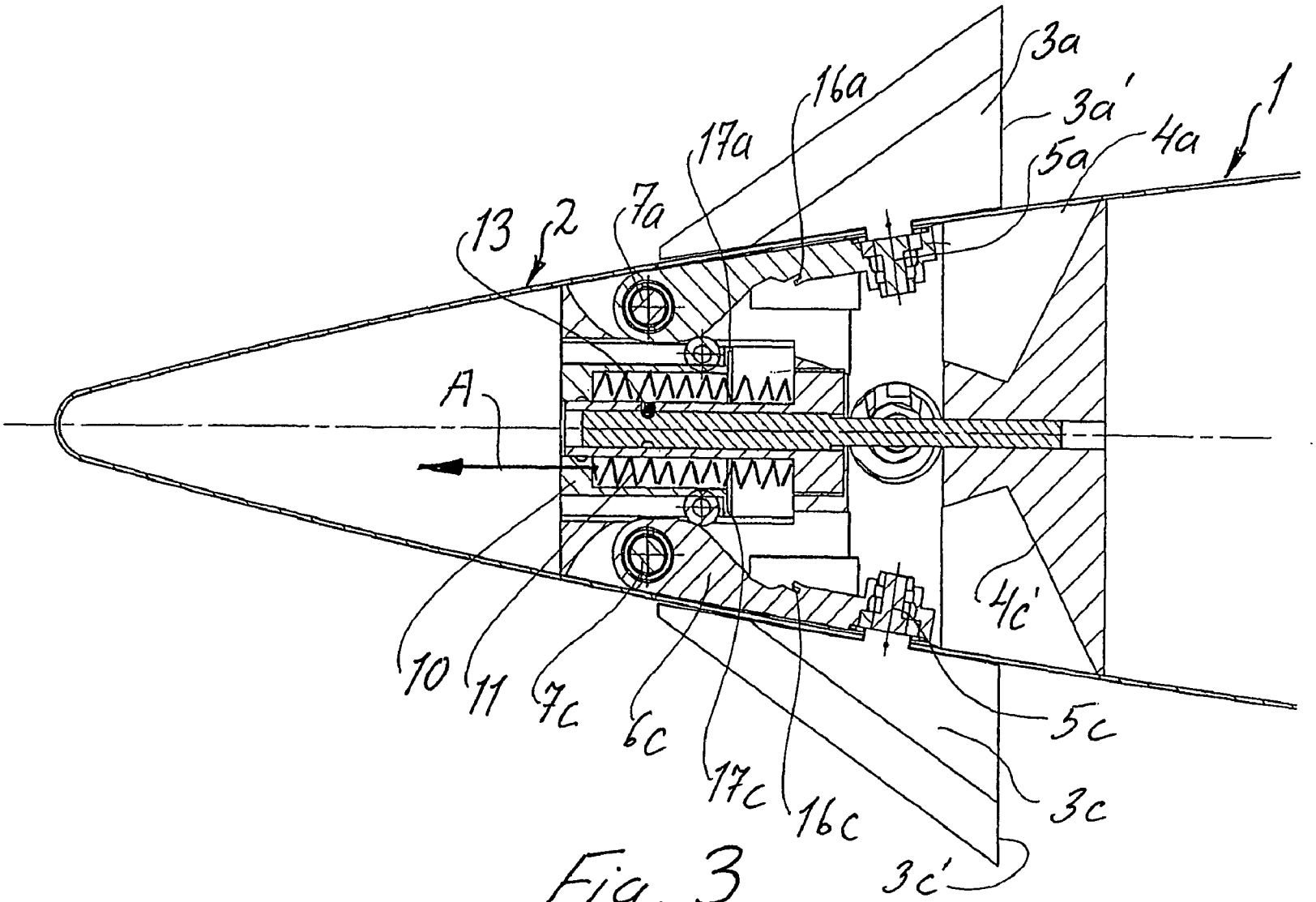
Figure 4:
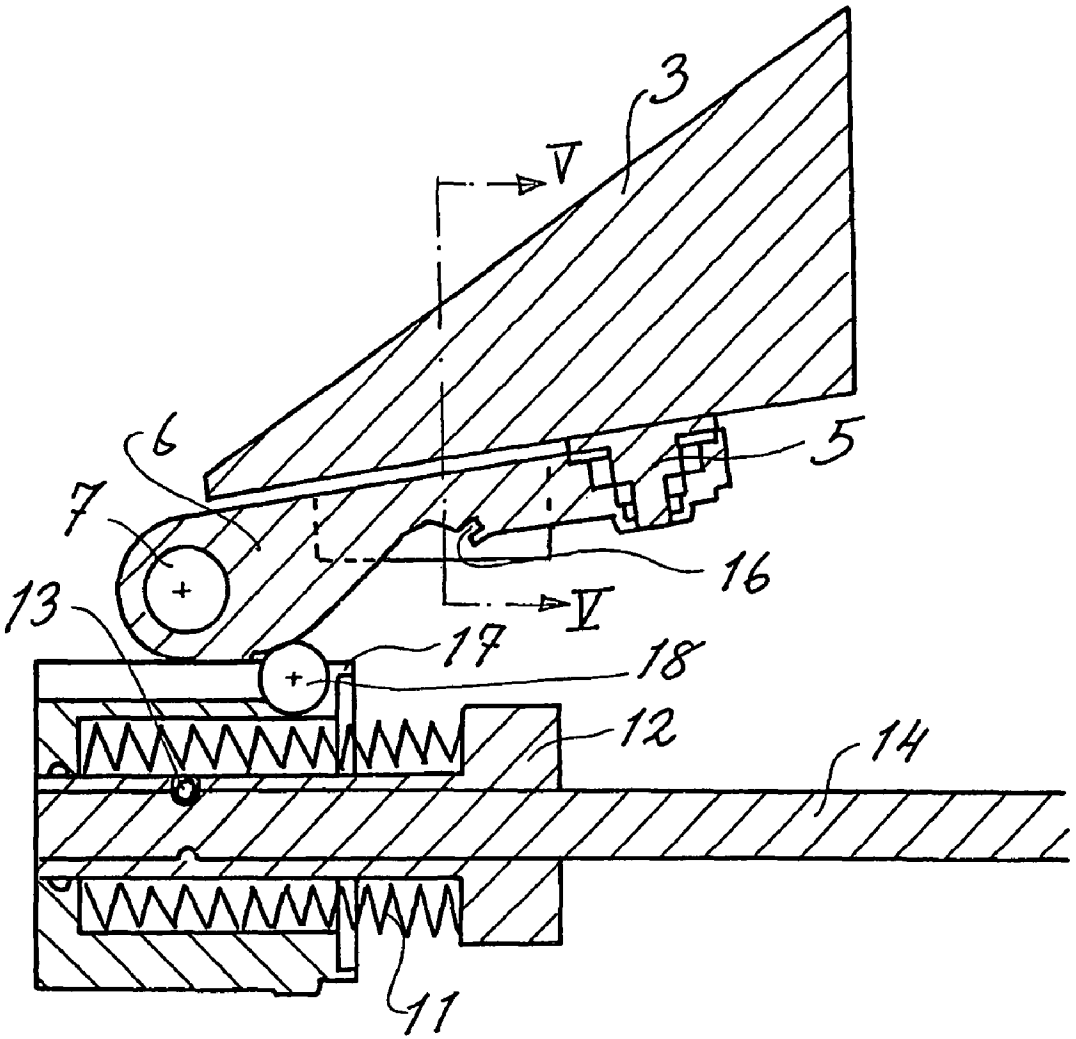
Figure 5:
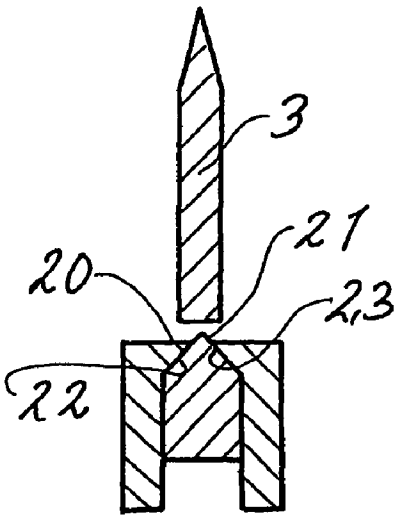
Figure 6:
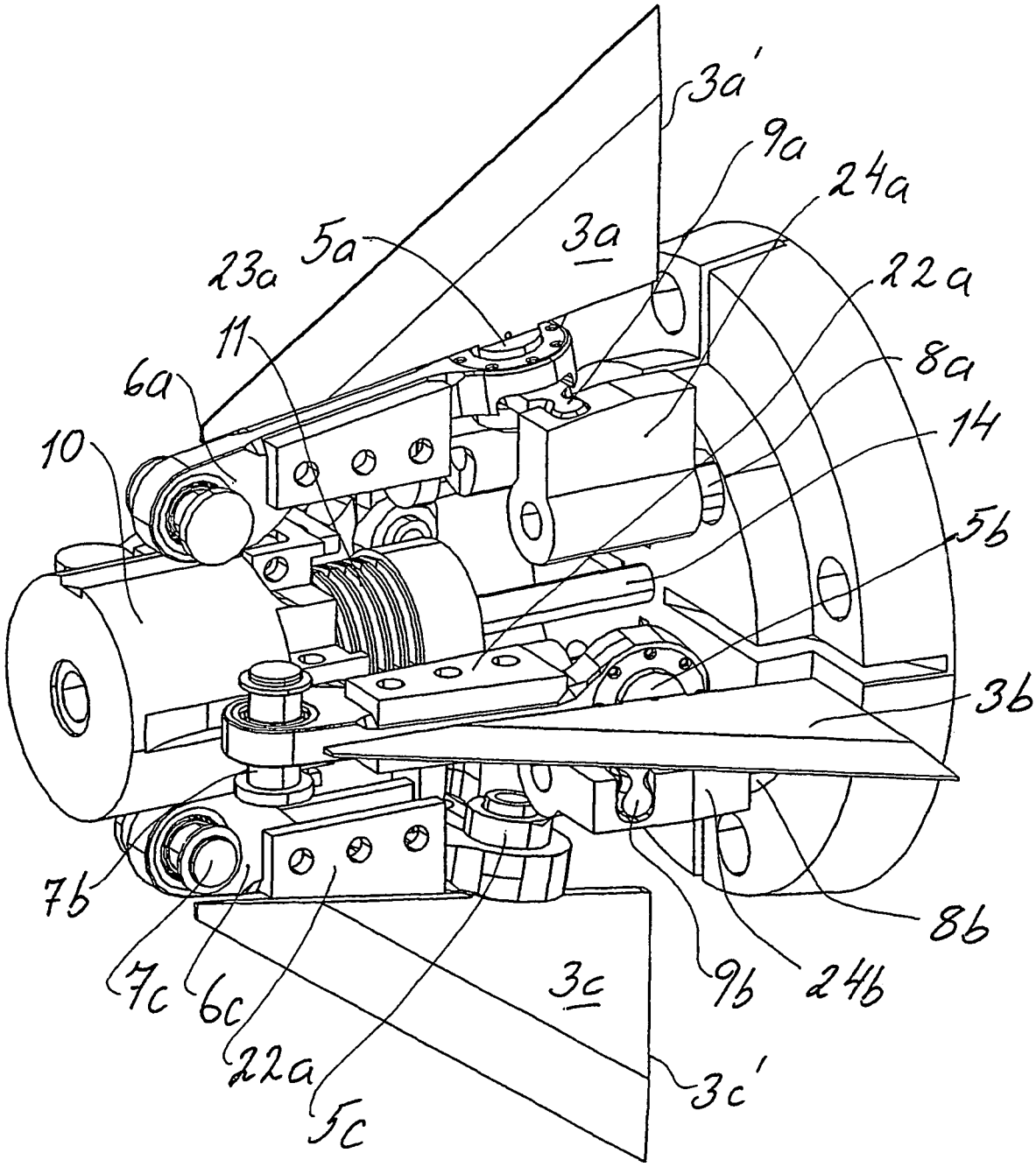

Of the Figures:

FIG. 1 shows a longitudinal section through the front part of the shell with the fins retracted FIG. 2 shows the same section as FIG. 1, but with the fins moving out and FIG. 3 shows the same section as in FIGS. 1 and 2, but with the fins fully deployed and FIG. 4 shows a detailed illustration of the fin deployment function for a fin on a somewhat larger scale FIG. 5 shows the section V—V in FIG. 4 on twice the scale and FIG. 6 shows an oblique projection of the fin stowage and deployment function according to FIGS. 1 to 5

The various parts have the same reference numbers in all figures and the parts that occur in each fin have been given the same reference number with the suffix a–d.

The shell body 1 with its front part 2, in which four identical canard fins 3*a*, 3*b*, 3*c*, 3*d* are retractably arranged, appears in the different figures. In these each canard fin 3*a–d* is deployable through a separate slot or slit 4*a–d* in the casing of the shell 1. In the starting position each slit is covered by a protective plate, which is designed with a defined fracture line along the edge of the slit and these defined fracture lines are easily pierced by each fin when it begins to move. In its passive retracted position, each canard fin 3*a–*3*d* has a zero alignment in a reference plane running through the central axis of the shell 1 and the fins in their deployed active positions can then be angled relative to their reference plane by being turned about a control shaft 5*a–d* arranged transversely to the intended direction of flight of the projectile. Each canard fin 3*a–d* is furthermore pivoted by its control shaft in a separate swivel arm 6*a–d* extending in the longitudinal direction of the shell. The control shaft bearings 5*a–d* are arranged at the trailing end of the swivel arms 6*a–d* in the direction of flight of the projectile 1, while the said swivel arms, which themselves therefore extend in the direction of flight of the projectile, are supported at their respective front ends about their own swivel shaft 7 *a–d* arranged transversely to the direction of flight of the projectile 1, these shafts extending transversely to the intended direction of flight of the projectile and perpendicular to each control shaft 5*a–d*.

In their retracted positions the canard fins 3*a–d*, as will be seen from FIG. 1, are situated in their retracted positions entirely inside the ballistic outer skin of the projectile and in this position the trailing edge, denoted by 3*a*'–3*d*', of each fin rests against the opposed trailing edge 4*a*'–4*d*' in each slot 4*a–d*. The fact that the fins are at all times retracted during launching means that during the launch they will be supported throughout along each trailing edge, which significantly reduces the acceleration loads acting thereon during the actual launch. In their fully deployed position the fins can be individually manoeuvred by means of push-draw rods 8*a–d* coupled to electric motors or the like, by way of recirculating ball screws, for example, (only 8*a* and 8*b* are visible in FIG. 6), which in turn operate the fins 3*a–d* by way of control arms 9*a–d*, to which they are fixed (only 9*a* and 9*b* in FIG. 6).

For manoeuvring the swivel arms 6*a–d* from their retracted position with the canard fins in their passive position into their deployed position with the canard fins 3*a–d* in their active position, use is made, according to the alternative shown in the figures, of an operating element 10 common to all canard fins, which operates all swivel arms simultaneously. The operating element 10 takes the basic form of a cylindrical vessel filled with spring washers 11, which in the compressed state endeavour to displace the operating element in the direction of the arrow A. In the original position the operating element is locked relative to its counter-stop 12 by a ball catch containing a number of locking balls 13. Running in the centre of the counter-stop is an operating shaft 14, which is in turn provided with a circumferential slot 15 and when the operating element 10 is to be triggered in order to deploy the fins, the said operating shaft is displaced so that the locking balls 13, of which there may be a plurality, drop down into the slot 15 and the operating element is released. In its first limited movement, which is accordingly forwards in the direction of flight of the projectile, locking heels 17*a–d* are released that fit into matching slots 16*a–d* in each swivel arm 6*a–d* respectively. In the example shown a circumferential flange edge fulfils the function of all locking heels 17. The object of the initial locking is to lock the swivel arms 6*a–d* to prevent accidental deployment due to a high centrifugal load, for example. As soon as the operating element 10 has begun its movement and the said locking is released, the operating element 10, which bears by way of control wheels 18*a–d* against control cams 19*a–d* formed on the underside of the swivel arms, will displace the swivel arms 6*a–d* towards their outer positions.

In order to define the outer positions of the swivel arms, they are each designed with two support surfaces 20*a–d*, 21*a–d* converging on one another in the direction of movement of the swivel arms, which surfaces are designed to interact in pairs with fixed locking surfaces 22*a–d*, 23*a–d*, opposed to the said support surfaces and converging on one another in the direction of movement of each swivel arm, residual spring loading in the operating element pressing the said support and locking surfaces on each swivel arm 6*a–d* against one another by way of the control cams and thereby fixing the fins 3*a–d* in their active outer positions.

When the control fins are to be activated, the operating shaft 14 is displaced in the direction of the arrow A, the balls 13 dropping into the slot 15 and the operating element 10 being released and driven forward by the spring washer assembly 11 in the direction of flight of the projectile 1, and the locking of 16*a–d* to 17*a–d* first releasing its grip before the operating element 10, by way of its control wheels 18*a–d* and their bearing against the control cams 19*a–d*, drives the swivel arms towards their deployed position, in which the support surfaces 20*a–d* and 21*a–d* are forced into contact with the locking surfaces 22*a–d* and 23*a–d* and fix the final position of the swivel arms, in which they are pressed by the residual spring force in the spring assembly 11. In this final position the draw rods 8*a–d* have been connected to the control arms 9*a–d* of the fins and the fins 3*a–d* are ready to correct the trajectory of the projectile 1 as required.

As already stated in the introductory part, each canard fin 3*a–d* is provided with a separate control arm 9*a–d*, which when each canard fin is in its respective deployed position is connected by way of a slide 24*a–d* to the aforementioned respective draw rods 8*a–d*. The draw rods 8*a–d* and the slides 24*a–d* can be axially displaced by means of an electric motor and recirculating ball screw forwards and backwards parallel to the longitudinal axis of the shell, so that the shafts, the slides and the motors can be mounted in the same direction, which limits the stresses acting on these during the launch phase.

Since the control shafts 5*a–d* of the canard fins 3*a–d* with the fins in the deployed position are angled in relation to the direction of movement of the slides 24*a–d*, the control arms 9*a–d* of the canard fins have been designed with an outer ball-and-socket joint, which on deployment is in turn carried into a guide slot in each slide 24*a–d*.

The invention claimed is:

1. A canard fin unit suitable for attachment to an artillery projectile having an aerodynamic outer shape, the fin unit comprising:

a plurality of canard fins which are each capable of deployment from a retracted position within the aerodynamic outer shape into a deployed position, wherein each of the plurality of canard fins is located outside the aerodynamic outer shape after the artillery projectile has been launched;

a plurality of swivel arms each arranged along a longitudinal direction of the artillery projectile and coupled to an associated one of the plurality of canard fins so that each of the plurality of canard fins is individually pivotable on the associated swivel arm about a control shaft that is arranged in a direction transverse to the longitudinal direction of the artillery projectile and supported by the swivel arm;

a plurality of control arms, each of which is coupled to a respective one of the plurality of swivel arms, wherein each of the plurality of control arms is aligned transversely to a surface area of an associated canard fin; and a plurality of operating rods, each of said plurality of operating rods being operably connected to a respective one of the plurality of control arms, wherein, when the associated canard fin is in the deployed position, said each of said plurality of operating rods is displaceable in the longitudinal direction of the projectile to effect a control function of the projectile, wherein each of the plurality of swivel arms are supported at one end thereof in a manner that allows each of the plurality of swivel arms to rotate about an associated swivel shaft arranged transversely to the longitudinal direction of the artillery projectile and perpendicular to said control shaft, and wherein a movement pattern of each of the plurality of swivel arms comprises rotating the associated one of the plurality of canard fins outward from the retracted position within the aerodynamic outer shape into the deployed position.

2. The canard fin unit of claim 1, wherein each of the associated swivel shafts is arranged ahead of the associated canard fin along the longitudinal direction in a flight direction of the artillery projectile.

3. The canard fin unit of claim 1, further comprising a plurality of slots located within the aerodynamic outer shape, wherein the plurality of slots are configured to accommodate the plurality of canard fins in the retracted position, wherein an edge side in each of the plurality of slots is arranged such that, in the retracted position, a trailing edge of an associated canard fin bears against the edge side; and wherein each of the plurality of swivel arms is supported at a position located ahead of a leading edge of the associated canard fin.

4. A canard fin unit suitable for attachment to an artillery projectile having an aerodynamic outer shape, the fin unit comprising:

a plurality of canard fins which are each capable of deployment from a retracted position within the aerodynamic outer shape into a deployed position, wherein each of the plurality of canard fins is located outside the aerodynamic outer shape after the artillery projectile has been launched;

a plurality of swivel arms each arranged along a longitudinal direction of the artillery projectile and coupled to an associated one of the plurality of canard fins so that each of the plurality of canard fins is individually pivotable on the associated swivel arm about a control shaft that is arranged in a direction transverse to the longitudinal direction of the artillery projectile and supported by the swivel arm; and a command-controlled operating element that is displaceable in the longitudinal direction and bears against control cams arranged on an inner edge side of each of the swivel arms facing a centerline of the projectile, and which comprises locking edges which are initially locked in respective locking slots in each of the plurality of swivel arms so as to prevent movement of a swivel arm, wherein, said command-controlled operating element is operable to release said locking edges and thereafter cause movement of the plurality of swivel arms and the plurality of canard fins from the retracted position to the deployed position, wherein each of the plurality of swivel arms are supported at one end thereof in a manner that allows each of the plurality of swivel arms to rotate about an associated swivel shaft arranged transversely to the longitudinal direction of the artillery projectile and perpendicular to said control shaft, and wherein a movement pattern of each of the plurality of swivel arms comprises rotating the associated one of the plurality of canard fins outward from the retracted position within the aerodynamic outer shape into the deployed position.

5. The canard fin unit of claim 4, further comprising a plurality of slots located within the aerodynamic outer shape, wherein the plurality of slots are configured to accommodate the plurality of canard fins in the retracted position, wherein an edge side in each of the plurality of slots is arranged such that, in the retracted position, a trailing edge of an associated canard fin bears against the edge side, and wherein each of the plurality of swivel arms is supported at a position located ahead of a leading edge of the associated canard fin.

6. A canard fin unit suitable for attachment to an artillery projectile having an aerodynamic outer shape, the fin unit comprising:

a plurality of canard fins which are each capable of deployment from a retracted position within the aerodynamic outer shape into a deployed position, wherein each of the plurality of canard fins is located outside the aerodynamic outer shape after the artillery projectile has been launched;

a plurality of swivel arms each arranged along a longitudinal direction of the artillery projectile and coupled to an associated one of the plurality of canard fins so that each of the plurality of canard fins is individually pivotable on the associated swivel arm about a control shaft that is arranged in a direction transverse to the longitudinal direction of the artillery projectile and supported by the swivel arm;

wherein each of the plurality of swivel arms are supported at one end thereof in a manner that allows each of the plurality of swivel arms to rotate about an associated swivel shaft arranged transversely to the longitudinal direction of the artillery projectile and perpendicular to said control shaft, and wherein a movement pattern of each of the plurality of swivel arms comprises rotating the associated one of the plurality of canard fins outward from the retracted position within the aerodynamic outer shape into the deployed position, wherein each of the plurality of swivel arms comprises support surfaces arranged in a plane in which said rotating is performed and which are configured to interact with opposing stop surfaces when the plurality of swivel arms are in the deployed position, wherein the operating element acts on the plurality of swivel arms in respective directions of deployment after said plurality of swivel arms have completed movement to the deployed position.

7. The canard fin unit of claim 6, wherein the operating element comprises a preloaded spring assembly, wherein at least a portion of spring force stored in the spring assembly is released when the plurality of canard fins are moved to the deployed position, wherein the spring assembly is arranged such that a direction of a preloading of the spring assembly aligns with an acceleration resulting from a firing of the artillery projectile.

8. The canard fin unit of claim 6, further comprising a plurality of slots located within the aerodynamic outer shape, wherein the plurality of slots are configured to accommodate the plurality of canard fins in the retracted position, wherein an edge side in each of the plurality of slots is arranged such that, in the retracted position, a trailing edge of an associated canard fin bears against the edge side, and wherein each of the plurality of swivel arms is supported at a position located ahead of a leading edge of the associated canard fin.

9. A canard fin unit suitable for attachment to an artillery projectile having an aerodynamic outer shape, the fin unit comprising:

a plurality of canard fins which are each capable of deployment from a retracted position within the aerodynamic outer shape into a deployed position, wherein each of the plurality of canard fins is located outside the aerodynamic outer shape after the artillery projectile has been launched;

a plurality of swivel arms each arranged along a longitudinal direction of the artillery projectile and coupled to an associated one of the plurality of canard fins so that each of the plurality of canard fins is individually pivotable on the associated swivel arm about a control shaft that is arranged in a direction transverse to the longitudinal direction of the artillery projectile and supported by the swivel arm; and a preloaded spring assembly, wherein at least a portion of spring force stored in the spring assembly is released when the plurality of canard fins move to the deployed position, wherein the spring assembly is arranged such that a direction of a preloading of the spring assembly aligns with an acceleration resulting from a firing of the artillery projectile, wherein each of the plurality of swivel arms are supported at one end thereof in a manner that allows each of the plurality of swivel arms to rotate about an associated swivel shaft arranged transversely to the longitudinal direction of the artillery projectile and perpendicular to said control shaft, and wherein a movement pattern of each of the plurality of swivel arms comprises rotating the associated one of the plurality of canard fins outward from the retracted position within the aerodynamic outer shape into the deployed position.

* * * * *